United States Patent [19]

Lea

[11] Patent Number: 4,835,096

[45] Date of Patent: May 30, 1989

[54] SENSITIZERS FOR PHOTOTHERMOGRAPHIC MEDIA

[75] Inventor: Bernard A. Lea, London, United Kingdom

[73] Assignee: Minnesota Mining and Manufacturing Company, St. Paul, Minn.

[21] Appl. No.: 33,999

[22] Filed: Apr. 2, 1987

[30] Foreign Application Priority Data

Apr. 30, 1986 [GB] United Kingdom ..... 8610615

[51] Int. Cl.[4] ..... G03C 1/00; G03C 1/02

[52] U.S. Cl. ..... 430/617; 430/584; 430/585; 430/619; 430/620

[58] Field of Search ..... 430/617, 619, 620, 584, 430/585

[56] References Cited

U.S. PATENT DOCUMENTS

| | | | |
|---|---|---|---|
| 3,623,882 | 11/1971 | Götze et al. | 430/584 |
| 3,719,495 | 3/1973 | Lea | 96/114.1 |
| 4,336,321 | 6/1982 | Kanada et al. | 430/583 |
| 4,476,220 | 10/1984 | Penfound | 430/620 |
| 4,524,128 | 6/1985 | Edwards et al. | 430/584 |

FOREIGN PATENT DOCUMENTS

| | | | |
|---|---|---|---|
| 62-62354 | 3/1987 | Japan | 430/585 |

*Primary Examiner*—Mukund J. Shah

*Attorney, Agent, or Firm*—Donald M. Sell; Walter N. Kirn; Mark A. Litman

[57] ABSTRACT

Photothermographic elements of the dry silver type may be sensitized to the infrared with sensitizing dyes of the formula:

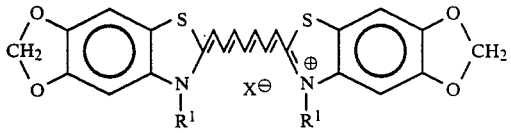

in which:

$R^1$ represents a lower alkyl group of from 1 to 5 carbon atoms and $X^-$ represents an anion.

20 Claims, No Drawings

SENSITIZERS FOR PHOTOTHERMOGRAPHIC MEDIA

FIELD OF THE INVENTION

This invention relates to a group of cyanine dyes which have been found to possess unexpected and particularly advantageous properties for the spectral sensitisation of photothermographic imaging media.

BACKGROUND TO THE INVENTION

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so than when silver specks or nuclei are generated by the irradiation or light exposure of photothermographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source as disclosed in U.S. Pat. No. 3,457,075, coprecipitation of the silver halide and silver source material as disclosed in U.S. Pat. No. 3,839,049, and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image.

Many cyanine and related dyes are well known for their ability to impart spectral sensitivity to a gelatino silver halide system. The wavelength of peak sensitivity is a function of the dye's wavelength of peak light absorbance. Whilst many such dyes provide some spectral sensitisation in dry silver formulations the dye sensitisation is often very inefficient and it is not possible to translate the performance of a dye in gelatino silver halide systems to dry silver systems. The emulsion making procedures and chemical environment of dry silver systems are very harsh compared to those of gelatino silver halide systems. The presence of large surface areas of fatty acids and fatty acid salts restricts the surface deposition of sensitising dyes onto silver halide surfaces and may remove sensitising dye from the surface of the silver halide grains. The large variations in pressure, temperature, pH and solvency encountered in the preparation of dry silver formulations aggravate the problem. Thus sensitising dyes which perform well in gelatino silver halide systems are often inefficient in dry silver formulations. In general, it has been found that merocyanine dyes are superior to cyanine dyes in dry silver formulations as disclosed, for example in British Pat. No. 1 325 312 and U.S. Pat. No. 3 719 495.

Attempts to sensitise at the far red end of spectrum have produced somewhat variable results. In particular the use of cyanines to impart sensitivity in dry silver in the far red and near infra-red has given results quite inconsistent with the performance of such dyes in conventional gelatino silver halide materials. The art therefore leads towards modifying merocyanines. There are however very few merocyanines capable of absorbing at more than 750 nm and also there is uncertainty as to whether dyes which absorb will also sensitise.

The recent commercial availability of exposure sources emitting in the near infrared and in particular relatively high powered semiconductor devices emitting in this region has created a need to sensitise dry silver systems to match such exposure sources. In particular, it is necessary to match sources emitting in the wavelength range from 800 to 850 nm, which is towards the extreme end of sensitising dye art. Such materials find particular utility in laser scanning.

It has now been found that a small class of cyanine dyes possess unexpected and particularly advantageous properties of speed and stability which render the compounds particularly suitable for the use in the spectral sensitisation of dry silver systems to the near infrared.

SUMMARY OF THE INVENTION

According to the present invention there is a photothermographic element containing spectrally sensitising amount of a compound of the formula:

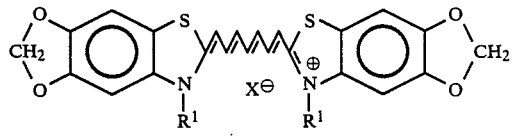

in which $R^1$ represents a lower alkyl group of 1 to 5 carbon atoms, preferably 1 to 3 carbon atoms, more preferably $C_2H_5$, $X^-$ represents an anion e.g. halide, preferably iodide.

The dyes of formula (1) are particularly effective sensitisers for dry silver systems and give surprisingly better sensitivity to near infrared radiation than other heptamethinethiacyanines of similar structure. In many cases compounds of the invention were found to give at least three times the sensitivity than that obtained using similar compounds. The dyes are particularly useful for sensitising dry silver systems in the region 820 to 850 nm thereby providing the photothermographic elements which are well matched to sources emitting in that region e.g. the following sources emitting at 830 nm:

830 nm an infrared emitting diode (IRED), part No. HLP60RC, commercically available from Hitachi Electronic Compnents (UK) Limited, and a laser diode, part No. LT-015MD, commercially available from Sharp Corporation, Osaka, Japan.

Heptamethine cyanine dyes are well known and described in the literature, as compounds and as near infrared spectral sensitisers for conventional photographic silver halide emulsions, e.g. Hamer, Cyanine Dyes and Related Compounds, Interscience 1964. However, the compounds of formula (1) are not known to have been used in photothermographic elements and the degree of sensitivity to near infrared radiation in dry silver systems imparted by these compounds is quite unexpected.

The synthesis of heptamethine cyanines is described by Fischer and Hamer, J.C.S. 189(1933) and dyes of formula (1) are disclosed in British Pat. Specification No. 425417.

The compounds of formula (1) may be incorporated into the photothermographic emulsions as spectral sensitisers in a conventional manner. Generally the concentration of the compounds of formula (1) will be in the range $1\times10^{-5}$ to $5\times10^{-3}$ moles of sensitising dye per mole of silver, preferably $5\times10^{-5}$ to $2\times10^{-3}$ moles of sensitising dye per mole of silver.

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material which will reduce silver ion to metallic silver. Conventional photographic developers such a phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefin, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in an range of from 20 to 75 percent by weight of each layer, and preferably about 30 to 55 percent by weight.

The substrates are generally photographic grade plastics films or paper such as polyester film, preferably biaxially orientated poly(ethylene terephthalate) film, vesicular polyester film, titanium dioxide pigmented polyester film, pigmented photographic grade paper e.g. baryta or titanium dioxide coated paper. Other subatrates may also be employed.

The invention will now be illustrated by the following Examples.

EXAMPLE 1

Preparation of bis(3-Ethyl-5,6-methylenedioxy-benzothiazole) heptamethinecyanine iodide.

(a) Preparation of 3-Ethyl-2-methyl-5,6-methylenedioxy-benzothiazolium iodide.

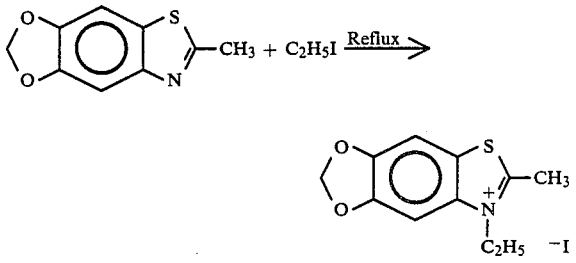

2-Methyl-5,6-methylenedioxy-benzothiazole (41.8 g) was mixed with an excess of iodoethane (50 ml) heated, and the resulting solution heated under reflux on a steam bath for about 100 hours to produce a buff coloured solid. Excess iodoethane was evaporated and the solid well ground before drying in vacuo for several hours at 50° C. The yield of 3-ethyl-2-methyl-5,6-methylenedioxy-benzothiazolium iodide was 69.5 g and represents 95% of theory.

(b) Preparation of bis(3-ethyl-5,6-methylenedioxy-benzothiazole) heptamethincyanine iodide.

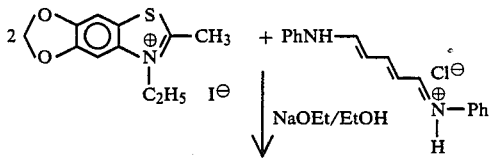

-continued

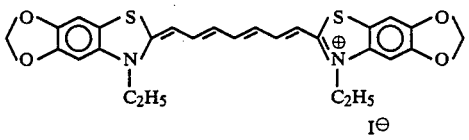

17.5 g of the dry finely ground quaternary salt prepared in (a) was mixed with glutaconic aldehyde dianil hydrochloride (7.14 g) and ethanol (150 ml). The suspension was agitated, warmed fairly rapidly and then a solution of sodium (1.15 g) in ethanol (20 ml) added quickly. The mixture was brought to the boil as rapidly as possible and heated under reflux for 2 to 2.5 minutes. The mixture became solid with separated dye and was set aside to cool to about 40° C., whereupon filtration was commenced. The damp cake of dye was washed with warm ethanol (30 ml) then with water (20 ml) in order to remove inorganic material-especially the sodium chloride formed in the reaction. After a further wash with ethanol (30 ml or more) the dye was dried in vacuo at 50° C. to give 11.2 g of product.

The crude dye obtained by the above synthesis was placed in methanol (100 ml), with stirring heated to the boil and after a few minutes reflux, filtered hot. The damp cake of dye was slurried with warm water (50 ml) again filtered and given two washes on the filter with methanol (25 ml + 12.5 ml), the alcoholic filtrates exhibiting only the blue colour of the product.

Vacuum drying gave a final yield of 10.2 g of dark green crystals.

In methanol solution (3 mg/1), the dye showed $E=1.97\times10^5$ at λmax 792 nm.

In Examples 2 and 3 the following sensitising dyes were used:

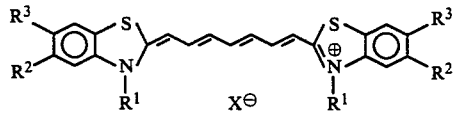

| Dye | $R^1$ | $R^2$ | $R^3$ | $X^-$ | |
|---|---|---|---|---|---|
| i | $C_2H_5$ | H | H | I | comparison |
| ii | $C_2H_5$ | $CH_3$ | H | I | comparison |
| iii | $C_2H_5$ | Cl | H | I | comparison |
| iv | $C_2H_5$ | $CH_3O$ | $CH_3O$ | I | comparison |
| v | $C_2H_5$ | —O—$CH_2$—O— | | I | invention. |

In Examples 2 and 3 the radiometric sensitivity values for the samples were determined using a tungsten light source and narrow band pass filters to allow transmission bands of radiation centred on 750, 800 and 850 nm. The combination of a tungsten light source and narrow band pass filters of transmission which closely represented the possible emission spectra of near infrared laser diodes was used to expose the coated compositions. The coatings were contact printed with a 0 to 4 continuous density wedge and a shutter to control the amount of total energy. The radiometric values were established using The International Light Company USA 700 System to calibrate these filtered exposures. After exposure, the coated strips were processed by heating at previous control processing conditions. Sensitivity was measured in ergs/cm$^2$ at a reflection gross density of 1.0.

EXAMPLE 2

A light sensitive dispersion was prepared consisting of silver behenate suspended in a mixture of toluene and methyl ethyl ketone in a ratio equal to 1:2:7 by weight. A small amount of N-methylpyrrolidone and polyvinyl butyral resin was added to form a 10.6% solids dispersion. Halidization was accomplished by the addition, with agitation, of mercuric and zinc bromide to convert a portion of the silver behenate to light sensitive silver bromide. This dispersion was allowed to digest 2 hours.

Poly(vinyl butyral) resin, in an amount that is 9.2% of the dispersion by weight, and a small amount of pyridine were added to stop the digestion process. The reducing agent, [2,2'methylenebis (4-ethyl-6-t-butylphenol)], which makes up 2.1% of the total dispersion was then added. Next, an amount of the sensitizing dye equal to $2.0\times10^{-4}$ moles per mole of silver was added to sensitize the dispersion to infrared radiation. In the final step a small amount of an aliphatic polyisocyanate compound was added to function as a hardening agent when the dispersion was coated.

A second mixture, known as a topcoat, was prepared consisting of binder resins, cellulose acetate and poly(methyl methacrylate), that total 5.7% of the mixture by weight. These resins were dissolved in acetone and isopropyl alcohol in the ratio of 1:12.5:4 by weight. The compounds that tone and catalyze the image formation were dissolved in the resin solution. These compounds are phthalazine, 4-methylphthalic acid, tetrachlorophthalic acid and tetrachlorophthalic anhydride.

The light sensitive dispersion was then coated 3.5 mils (88 microns) thick on white polyester substrate and dried in a 190° F. (88° C.) oven for 4 minutes. The coating was then overcoated with the topcoat solution at a 2-mil (50 microns) thickness and dried in a 190° F. (88° C.) oven for 4 minutes.

A sample was exposed to infrared radiation creating a latent image in the coating which was "developed" by immersing the sample for 10 seconds in an inert fluorochemical liquid medium heated to 260° F. (127° C.).

The sensitising dyes used and the sensitivities of the samples are reported in the following Table.

| | Sensitivity (ergs/cm$^2$) | | |
|---|---|---|---|
| | 750 nm | 800 nm | 820 nm |
| Dye (i) | 54 | 24 | 33 |
| Dye (v) | 30 | 12 | 10 |

It will be noted that dye (v) in accordance with the invention unexpectedly gives in excess of three times the sensitivity at 820 nm than the sensitivity obtained with dye (i).

EXAMPLE 3

A dry silver light sensitive dispersion was prepared. The dispersion is silver behenate half soap in a toluene-acetone mixture (1:2 by weight). The dispersion was accomplished by homogenization to yield an 11% solids suspension. At 20° C., with agitation, an equivalent amount of mercuric bromide was added to the suspension to convert 4.5% of the silver behenate to silver bromide. After the addition of the mercuric bromide solution, the batch is light sensitive and a Eastman Kodak Wratten 1A safelight environment maintained. The batch was allowed to digest for four hours at which time the binder, polyvinyl butyral, was added, equivalent to 10% of the finished batch. When the resin had dissolved the reducing agent, 2,2'methylenebis (4-methyl-6-tertiary-butyl-phenol), 2% of total batch, was added. The final addition before the batch was spectrally sensitized was 7 grams of a 30% solids methyl methacrylate resin solution. Prior to the addition of the spectral sensitizer the red safelight conditions were replaced with Eastman Kodak Wratten 7 safelighting. The spectral sensitizing dyes were predissolved in methanol at $5\times10^{-4}$ mole per litre. To 100 grams of the prepared dispersion 3 ml of the dye solution was added.

The spectrally sensitized suspension was wet coated at 4 mils (100 microns) on a photographic paper base and dried 3 minutes at 88° C. An overcoat was prepared by dissolving 4% cellulose acetate in a solvent mixture of acetone methanol-methyl ethyl ketone, 6:1:1.5 by weight. A combination of phthalazine, 4-methyl phthalic acid and tetrachlorophthalic acid to tone and catalyze the image formation was then dissolved in the resin solution. A small amount of a flattening agent, amorphous silica, was added. The overcoat was applied over the dried light sensitive layer at 3 mils (75 microns) wet orifice thickness. The coating construction was then dried for 3 minutes at 88° C. The resulting coating construction was then cut into strips which were exposed to infrared radiation of the desired wavelength and the exposed strip developed thermally for 3 seconds at 140° C.

The dyes used and the sensitivity of the samples are reported in the following Table.

| | Sensitivity (ergs/cm$^2$) | | |
|---|---|---|---|
| | 750 nm | 800 nm | 850 nm |
| Dye (i) | 118 | 100 | 667 |
| Dye (ii) | 144 | 74 | 540 |
| Dye (iii) | 850 | 351 | 1972 |
| Dye (iv) | 3630 | 2805 | 5290 |
| Dye (v) | 214 | 88 | 187 |

It will be seen that dye (v) in accordance with the invention gives in excess of three times the sensitivity at 850 nm than the sensitivity obtained with any one of dyes (i) to (iv).

I claim:

1. A photothermographic element characterised in that it contains as a sensitiser a dye of the general formula:

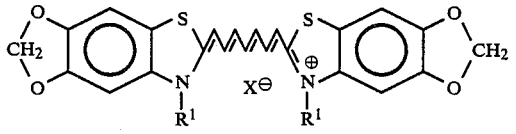

in which:

$R^1$ represents a lower alkyl group of from 1 to 5 carbon atoms and $X^-$ represents an anion.

2. A photothermographic element as claimed in claim 1 characterised in that $R^1$ represents an alkyl group of from 1 to 3 carbon atoms.

3. A photothermographic element as claimed in claim 2 characterised in that $R^1$ represents $C_2H_5$.

4. A photothermographic element as claimed in claim 1 characterised in that $X^-$ represents halide.

5. A photothermographic element as claimed in claim 4 characterised in that $X^-$ represents $I^-$.

6. A photothermographic element as claimed in claim 1 characterised in that the dye is Bis(3-ethyl-5,6-methylenedioxy-benzothiazole)heptamethinecyanine iodide.

7. A photothermographic element as claimed in claim 1 characterised in that the photothermographic element comprises a mixture of light sensitive silver halide, a silver salt of an organic acid and an organic reducing agent.

8. A photothermographic element as claimed in claim 1 characterised in that the concentration of sensitising dye is in the range $1\times10^{-5}$ to $5\times10^{-3}$ moles of sensitising dye per mole of silver.

9. A photothermographic element as claimed in claim 8 characterised in that the concentration of sensitising dye is in the range $5\times10^{-5}$ to $2\times10^{-3}$ moles of sensitising dye per mole of silver.

10. A photothermographic element as claimed in claim 2 characterised in that the photothermographic element comprises a mixture of light sensitive silver halide, a silver salt of an organic acid and an organic reducing agent.

11. A photothermographic element as claimed in claim 3 characterised in that the photothermographic element comprises a mixture of light sensitive silver halide, a silver salt of an organic acid and an organic reducing agent.

12. A photothermographic element as claimed in claim 4 characterised in that the photothermographic element comprises a mixture of light sensitive silver halide, a silver salt of an organic acid and an organic reducing agent.

13. A photothermographic element as claimed in claim 5 characterised in that the photothermographic element comprises a mixture of light sensitive silver halide, a silver salt of an organic acid and an organic reducing agent.

14. A photothermographic element as claimed in claim 6 characterised in that the photothermographic element comprises a mixture of light sensitive silver halide, a silver salt of an organic acid and an organic reducing agent.

15. A photothermographic element as claimed in claim 2 characterised in that the concentration of sensitising dye is in the range $5\times10^{-5}$ to $2\times10^{-3}$ moles of sensitising dye per mole of silver.

16. A photothermographic element as claimed in claim 5 characterised in that the concentration of sensitising dye is in the range $5\times10^{-5}$ to $2\times10^{-3}$ moles of sensitising dye per mole of silver.

17. A photothermographic element as claimed in claim 6 characterised in that the concentration of sensitising dye is in the range $5\times10^{-5}$ to $2\times10^{-3}$ moles of sensitising dye per mole of silver.

18. A photothermographic element as claimed in claim 7 characterised in that the concentration of sensitising dye is in the range $5\times10^{-5}$ $2\times10^{-3}$ moles of sensitising dye per mole of silver.

19. A photothermographic element as claimed in claim 11 characterised in that the concentration of sensitising dye is in the range $5\times10^{-5}$ to $2\times10^{-3}$ moles of sensitising dye per mole of silver.

20. A photothermographic element as claimed in claim 13 characterised in that the concentration of sensitising dye is in the range $5\times10^{-5}$ to $2\times10^{-3}$ moles of sensitising dye per mole of silver.

* * * * *